US006651774B2

(12) United States Patent
Yoo

(10) Patent No.: US 6,651,774 B2
(45) Date of Patent: Nov. 25, 2003

(54) COMBINED STEPLADDER AND HAND TRUCK ASSEMBLY

(76) Inventor: Hoe Gwan Yoo, 11092 Linda La. #B, Garden Grove, CA (US) 92840

( * ) Notice: Subject to any disclaimer, the term of this patent is extended or adjusted under 35 U.S.C. 154(b) by 47 days.

(21) Appl. No.: 10/074,428

(22) Filed: Feb. 19, 2002

(65) Prior Publication Data

US 2003/0155178 A1 Aug. 21, 2003

(51) Int. Cl.[7] ..... E06C 1/00

(52) U.S. Cl. ..... 182/20; 182/129; 182/161; 280/47.16; 280/47.28

(58) Field of Search ..... 182/20, 129, 161; 280/47.16, 47.18, 47.28

(56) References Cited

U.S. PATENT DOCUMENTS 4,053,028 A * 10/1977 Loix ..... 182/1
4,235,449 A 11/1980 Tarran ..... 280/30
4,284,286 A * 8/1981 Lewallen ..... 280/30
4,448,282 A 5/1984 Giezendanner ..... 182/22
4,471,969 A 9/1984 Zabala et al. ..... 280/30
4,557,350 A 12/1985 Wang ..... 182/33
6,000,497 A 12/1999 Kain et al. ..... 182/129
6,173,811 B1 * 1/2001 Tornabene et al. ..... 182/20

* cited by examiner

*Primary Examiner*—Alvin Chin-Shue
(74) *Attorney, Agent, or Firm*—Park & Sutton LLP; John K. Park

(57) ABSTRACT

A combined stepladder and hand truck assembly is provided. The assembly comprises a first frame having two side rails, a second frame pivotally attached to the back side of the first frame and having two side rails, and a third frame pivotally attached to the front side of the first frame and having two side rails. Steps and bars are provided so that they form a parallel link together with the side rails of the first frame. Two casters attached at the lower end of the first frame. A tool tray is provided at the lower end of the third frame. The tray is kept vertical to the frames when the assembly is used as a hand truck, and is kept horizontal when the assembly is used as a stepladder and the third frame is rotated upward to support the tool tray in a high position.

19 Claims, 14 Drawing Sheets

COMBINED STEPLADDER AND HAND TRUCK ASSEMBLY

BACKGROUND OF THE INVENTION

The present invention relates to a stepladder.

More particularly, the invention relates to a stepladder that has multiple functions useful for every day use.

There are many prior art stepladders that have additional functions such as hand truck, and tool tray, etc.

U.S. Pat. No. 4,235,449 shows a combined hand truck and step stool. Usually, it is used as a hand truck. To use it as a step stool, the steps of pivoting side rails, reversing the entire device, and locking a support are required. Also, the device is quite bulky even in its storage state since many parts such as wheels, steps, and a bed are fixed.

U.S. Pat. No. 4,448,282 shows a ladder formed as a multiple-purpose device. To convert the ladder between a step ladder, a leaning type ladder, and a hand truck, the steps of disassembling the beams forming the ladder and reassembling them are required. The conversion is not achieved in a simple step like unfolding a parallel link. A disadvantage of the prior art multi-function stepladders is that they are bulky in size compared to a simple stepladder. Another disadvantage is that it is cumbersome to convert the stepladder between the multiple functions.

Accordingly, there has been a demand for an improved multi-function stepladder having a compact size and easy to convert between the multiple functions.

SUMMARY OF THE INVENTION

The present invention is contrived to overcome the conventional disadvantages. Therefore, an object of the invention is to provide an enhanced stepladder having multiple functions.

Another object of the invention is to provide a combined stepladder and hand truck assembly having the functions as a stepladder, a tool tray, and a hand truck.

Still another object of the invention is to provide a combined stepladder and hand truck assembly which is easy to convert between its functions.

Still another object of the invention is to provide a combined stepladder and hand truck assembly which is compact in its size.

To achieve the above-described objects, in accordance with an embodiment thereof, the invention provides a combined stepladder and hand truck assembly that comprises a first frame having two side rails, each of the side rails having a lower end, a second frame pivotally attached to the back side of the first frame and having two side rails, each of which having an upper end and pivotally attached to the side rail of the first frame at the upper end, a third frame pivotally attached to the front side of the first frame and having two side rails, each of which having an upper end and a lower end and pivotally attached to the side rail of the first frame at the upper end, two bars, a plurality of steps pivotally attached to the side rails of the first frame and the bars so that the steps, the side rails of the first frame, and the bars form a parallel link, a lock securing the second frame with the first frame at an acute angle between the second frame and the first frame, two casters attached at the lower end of the side rail of the first frame, a fastener securing the third frame to the first frame, a tray rotatably attached to the third frame at the lower ends of the side rails of the third frame, and a stop limiting the rotation of the tray.

The assembly has a folded position, a hand truck position, a stepladder position, and a tool tray position.

In the folded position, the second frame and the third frame abut on the first frame, the lock is released, the fastener is released, the link is folded between the side rails of the first frame and the second frame, and the tray is folded between the side rails of the third frame.

In the hand truck position, the second frame and the third frame abut on the first frame, the lock is released, the fastener is released, the link is folded between the side rails of the first frame and the second frame, the tray is rotated downward until the tray abuts on the stop so that the tray is substantially vertical to the third frame.

In the stepladder position, the second frame is pivoted so that it makes the acute angle with the first frame, the lock is engaged, the third frame abuts on the first frame, the fastener is released, the link is unfolded so that the steps are substantially horizontal, and the tray is folded between the side rails of the third frame.

In the tool tray position, the second frame is pivoted so that it makes the acute angle with the first frame, the lock is engaged, the third frame is rotated upward, the fastener is engaged, the link is unfolded so that the steps are substantially horizontal, and the tray is rotated until the tray abuts on the stop so that the tray is substantially horizontal.

When the link is folded, the steps are pivoted downward so that the height of the entire assembly is just the sum of the heights of the first frame and the castors.

The stop comprises two brackets rotatably attached to the side rails of the third frame near the lower ends of the side rails, and a bar fixed between the brackets. The bar has a first wall and a second wall, and each of the bracket has a projection, and the first wall and the second wall makes an angle of approximately 90 degrees. When the assembly is in the hand truck position, the first wall abuts on the side rails of the third frame to block downward pivoting of the brackets, and the second wall abuts on the tray to block downward rotation of the tray. When the assembly is in the tool tray position, the projections abuts on the side rails of the third frame to block downward pivoting of the brackets, and the first wall abuts on the tray to block downward rotation of the tray.

The fastener includes a hook pivotally attached to the side rail of the third frame, a handle, and a spring. The hook engages a pin provided at the side rail of the first frame and the spring presses the hook so that the hook is kept engaged with the pin. The handle is used to pivot the fastener against the force of the spring to disengage the hook from the pin.

Each of the casters has a wheel bracket attached at the lower end of the side rail of the first frame, and a wheel rotatably attached to the wheel bracket. The wheel bracket is rotatable around the side rail and lockable on a first position, a second position, or a third position.

In the first position, the castors are positioned between the side rails of the first frame, and in the second position, the castors are rotated 90 degrees from the first position and backward from the first frame, and in the third position, the casters are rotated 180 degrees from the first position.

The castors are locked in the first position when the assembly is in the folded position to minimize the folded size of the assembly.

The castors are locked in the second position when the assembly is in the hand truck position.

The castors are locked in the third position when the assembly is in the stepladder position or in the tool tray position.

The side rails of the first frame are hollow, and the wheel bracket of the caster includes a wheel cover, a shaft, a pin, a first block, a second block, and a spring. The wheel is rotatably attached to the wheel cover and the shaft is fixed to the wheel cover. The first block is secured at the lower end of the side rail of the first frame and has a hole receiving the shaft. The second block is slidably received inside the side rail of the first frame and has a hole receiving the shaft. The pin is inserted into a bore provided at an end of the shaft and contacts with the second block to limit the sliding movement of the second block. The spring surrounds the shaft between the first block and the second block. The first block has a circular recess having four grooves spaced by 90 degrees with one another and the wheel cover has a circular boss received in the recess of the first block and having four projections spaced by 90 degrees with one another to engage with the recesses of the first block.

In accordance with another embodiment thereof, the invention provides a combined stepladder and hand truck assembly that comprises a first frame having two side rails, each of which having a lower end, a second frame pivotally attached to the back side of the first frame and having two side rails, each of which having an upper end and pivotally attached to the side rail of the first frame at the upper end, a third frame pivotally attached to the front side of the first frame and having two side rails, each of which having an upper end and a lower end and pivotally attached to the side rail of the first frame at the upper end, two bars, a plurality of steps pivotally attached to the side rails of the first frame and the bars so that the steps, the side rails of the first frame, and the bars form a parallel link, a lock securing the second frame with the link at an acute angle between the second frame and the first frame, two casters attached at the lower end of the side rail of the first frame, a fastener securing the third frame to the first frame, a tray rotatably attached to the third frame at the lower ends of the side rails of the third frame, and a stop limiting the rotation of the tray.

The assembly has a folded position, a hand truck position, a stepladder position, and a tool tray position.

In the folded position, the second frame and the third frame abut on the first frame, the lock is released, the fastener is released, the link is folded between the side rails of the first frame and the second frame, and the tray is folded between the side rails of the third frame.

In the hand truck position, the second frame and the third frame abut on the first frame, the lock is released, the fastener is released, the link is folded between the side rails of the first frame and the second frame, the tray is rotated downward until the tray abuts on the stop so that the tray is substantially vertical to the third frame.

In the stepladder position, the second frame is pivoted so that it makes the acute angle with the first frame, the lock is engaged, the third frame abuts on the first frame, the fastener is released, the link is unfolded so that the steps are substantially horizontal, and the tray is folded between the side rails of the third frame.

In the tool tray position, the second frame is pivoted so that it makes the acute angle with the first frame, the lock is engaged, the third frame is rotated upward, the fastener is engaged, the link is unfolded so that the steps are substantially horizontal, and the tray is rotated until the tray abuts on the stop so that the tray is substantially horizontal.

The lock comprises a tube positioned inside one of the steps, two rods received in the tube, each of which has an inner end and an outer end, a spring received in the tube between the inner ends of the rods and pushing the rods away from each other. Each of the rods comprises a handle fixed at the inner end of the rod. The handles pass through slots provided in the tube and in the step so that the handles can move within the slots to move the rods toward each other against the force of the spring. Each of the side rails of the second frame has a channel to receive the outer end of the rod, and the channel has a hole to receive the outer end of the rod at a position in which the first frame and the second frame makes the acute angle. The outer ends of the rods slide in the channels of the second frame during unfolding of the link, and are inserted into the holes of the second frame when the link is unfolded fully.

The advantages of the present invention are numerous in that: (1) the assembly has a very compact size; (2) only easy and simple operations are required to convert the assembly between the folded, hand truck, stepladder, and tool tray positions; and (3) the assembly is sturdy and stable when it is used in any positions.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to e accompanying drawings, wherein.

DETAILED DESCRIPTION OF THE PREFERRED EMBODIMENTS

Figure 1:
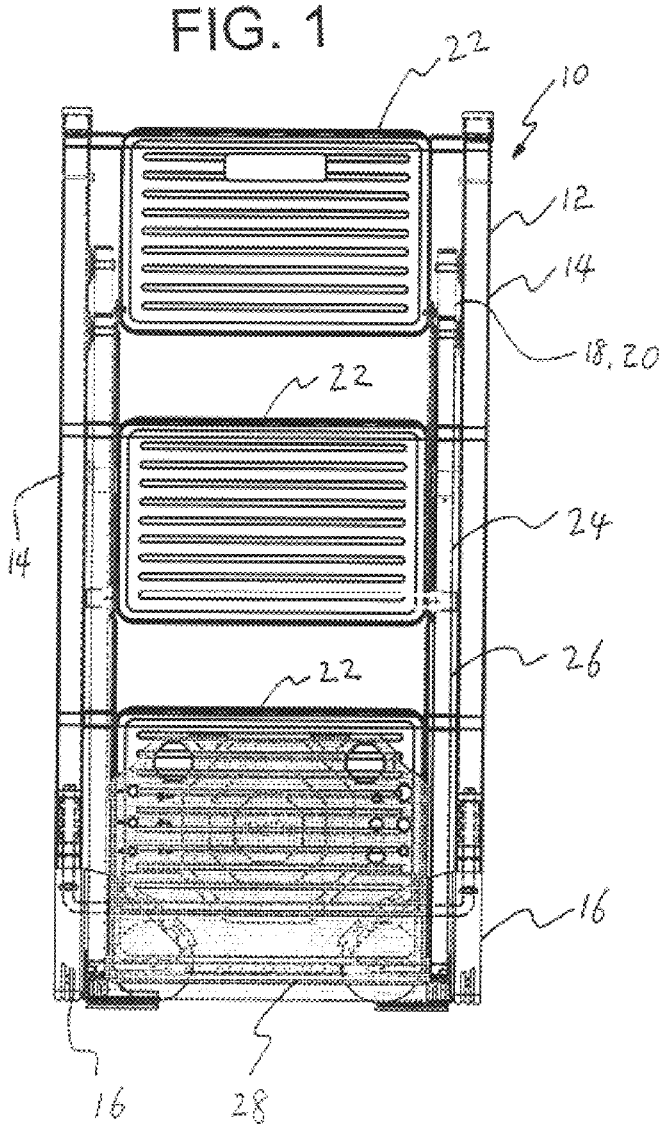
FIG. 1 is a front elevational view of a combined stepladder and hand truck assembly according to the present invention in a folded position.
Figure 2:
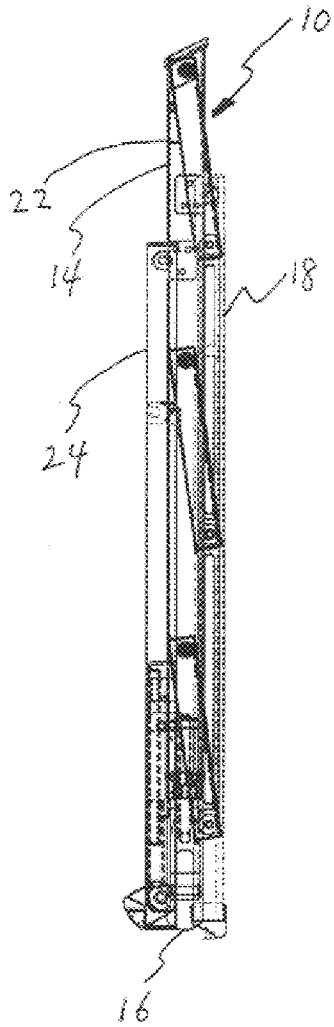
FIG. 2 is a side elevational view of the assembly in the folded position.

FIGS. 1 and 2 show a combined stepladder and hand truck assembly of the present invention in its folded position. The assembly 10 has a first frame 12 that has two side rails 14. A castor 16 is installed at the lower end of the each side rail 14. A second frame 18 is provided at the backside of the first frame 12 and abuts on the first frame 12. The second frame 18 has two side rails 20. The upper end of each of the side rails 20 is pivotally attached to the side rail 14 of the first frame 12 near the upper end of the side rail 14. Three steps 22 are pivotally attached to the side rails 14 of the first frame 12. A third frame 24 is provided at the front side of the first frame 12 and abuts on the first frame 12. The third frame 24 has two side rails 26. The upper end of each of the side rails 26 is pivotally attached to the side rail 14 of the first frame 12 slightly below the pivoting point of the second frame 18. A tray 28 is pivotally attached between the lower ends of the side rails 26 of the third frame 24. The tray 28 is shown as folded between the side rails 26. The steps 22 are shown as folded between the side rails 14 and 20. Also, the castors 16 are shown as folded between the side rails 14. Thus in the folded position, the assembly 10 has the overall height as the height of the first frame 12 plus the height of the castor 16, overall width as the width of the first frame 12, and overall thickness as the sum of the thickness of the three frames 12, 18, and 24. Therefore, the assembly 10 has a minimum possible size for efficient storage.

Figure 3:
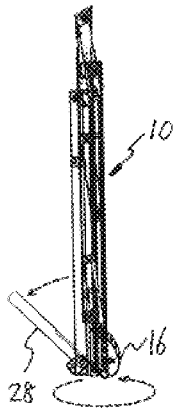
FIG. 3 is an illustrative view showing a transition state between the folded position and a hand truck position.

FIG. 3 shows a transition state of the assembly 10 between the folded position and the hand truck position. The tray 28 is pivoted downward and the castors 16 are rotated backward.

Figure 4:
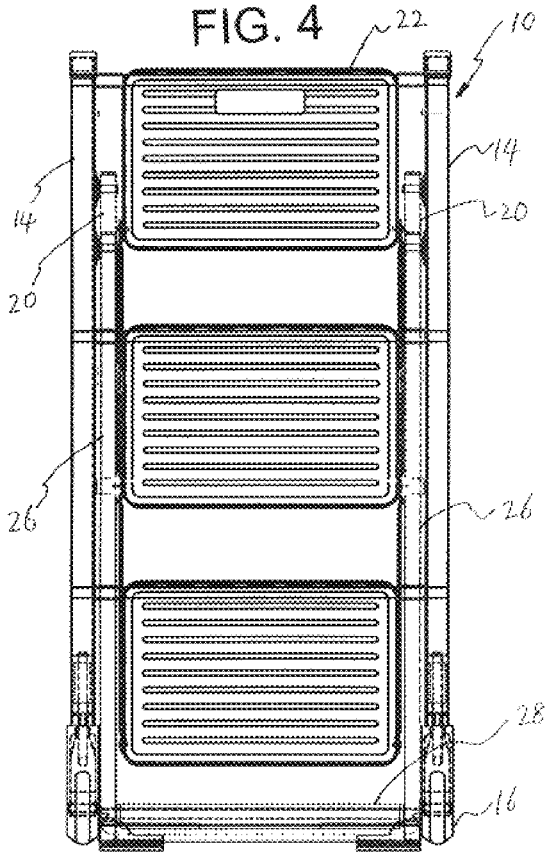
FIG. 4 a front elevational view of the assembly in the hand truck position.
Figure 5:
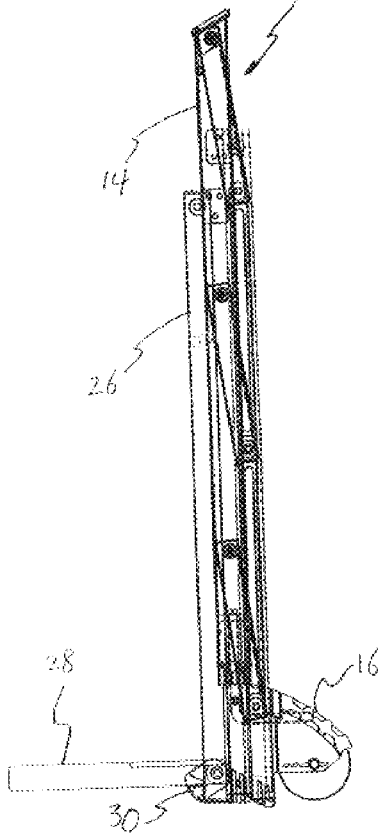
FIG. 5 is a side elevational view of the assembly in the hand truck position.

FIGS. 4 and 5 show the assembly 10 in the hand truck position. The tray 28 is pivoted downward so that it is substantially vertical to the side rails 26 of the third frame 24. A stop 30 is provided at the lower ends of the side rails 26 to stop further pivoting of the tray 28. The castors 16 are pivoted backward and locked in that position by a mechanism explained later referring FIGS. 24–33. Luggage or other loads are supported by the tray 28 and the third frame 24. The side rails 14 of the first frame 12 serve the role of handles. By leaning the assembly 10 slightly backward, the assembly 10 and the loads (not shown) are supported only by the castors 16, and the assembly 10 is ready to move. That is, the assembly 10 is easily converted to a hand truck simply by pivoting the tray 28 and the castors 16.

Figure 6:
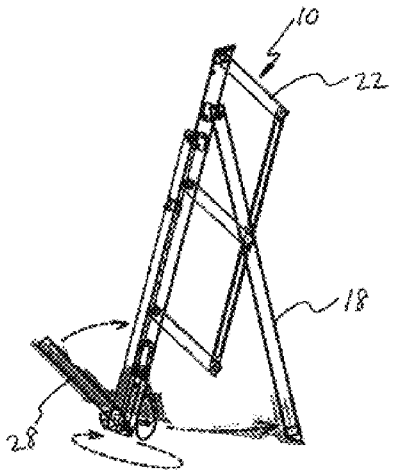
FIG. 6 is an illustrative view showing a transition state between the hand truck position and a stepladder position.

FIG. 6 shows a transition state of the assembly 10 between the hand truck position and the stepladder position. The tray 28 is pivoted upward and the castors 16 are rotated forward. Also, the steps 22 are unfolded and the second frame 18 is pivoted backward.

Figure 7:
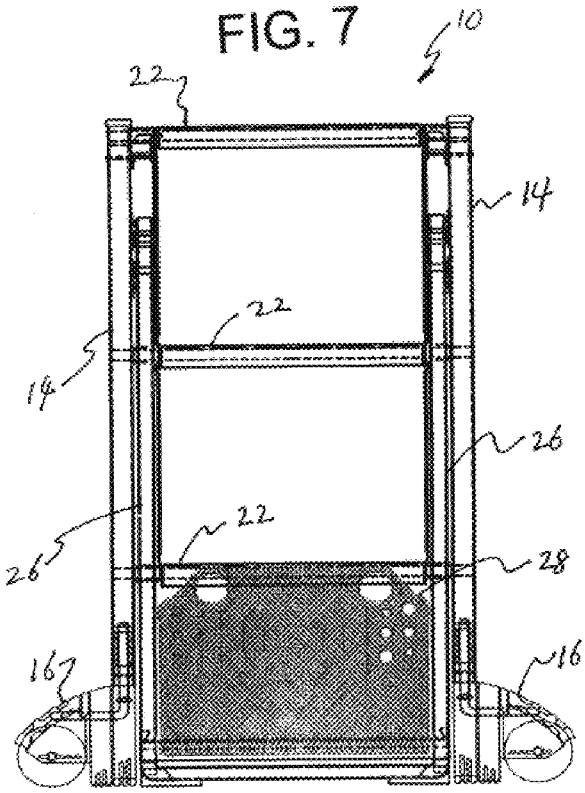
FIG. 7 is a front elevational view of the assembly in the stepladder position.
Figure 8:
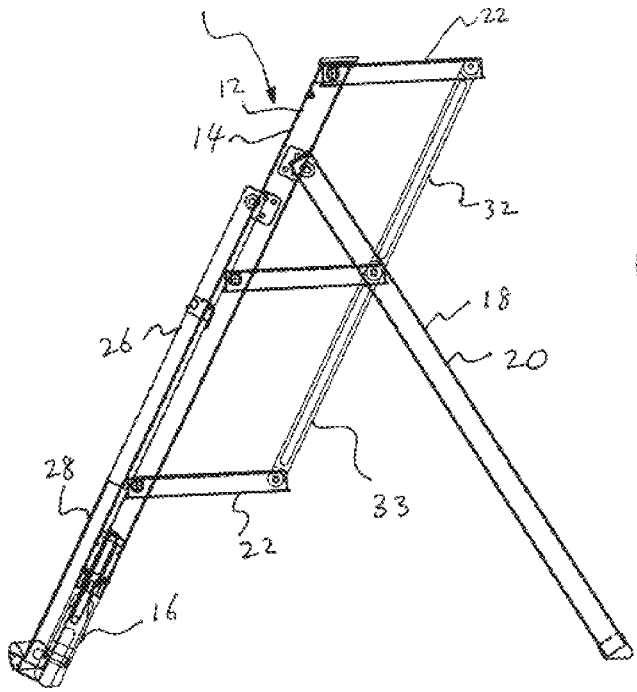
FIG. 8 is a side elevational view of the assembly in the stepladder position.

FIGS. 7 and 8 show the assembly 10 in the stepladder position. The tray 28 is folded between the side rails 26 of the third frame 24. The edge of the tray 28 lean on the step 22 that is positioned lowest so that the tray 28 does not swing down. The castors 16 are rotated outward, that is 180 degrees away from the folded state between the side rails 14 of the first frame 12, and locked in that position. This effectively increases the width of the assembly 10 and provides more stability when a user climb the assembly 10. The steps 22 are unfolded so that they are substantially horizontal. Two bars 32 are pivotally connected at the three steps 22 so that the side rails 14 of the first frame 12, the steps 22, and the bars 32 form a parallel link 33. The side rails 20 of the second frame 18 are pivoted backward until the second frame 18 makes a predetermined acute angle with the first frame 12. The second frame 18 is locked at the acute angle by a lock explained later referring to FIGS. 34–38.

Figure 9:
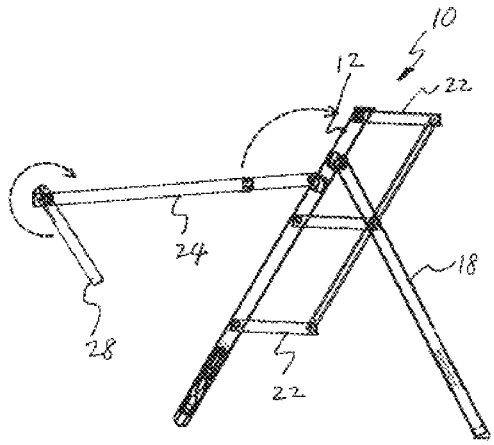
FIG. 9 is an illustrative view showing a transition state between the stepladder position and a tool tray position.

FIG. 9 shows a transition state of the assembly 10 between the stepladder position and the tool tray position. The third frame 24 is rotated upward and the tray 28 is rotated counterclockwise.

Figure 10:
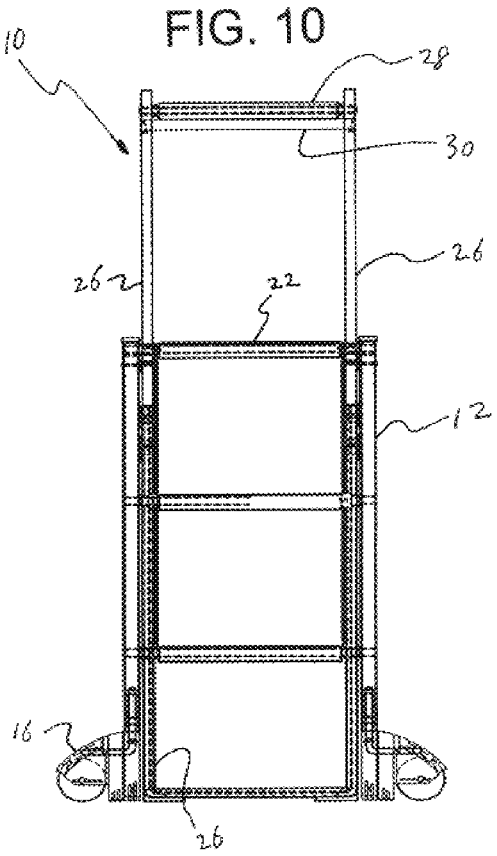
FIG. 10 is a front elevational view of the assembly in the tool tray position.
Figure 11:
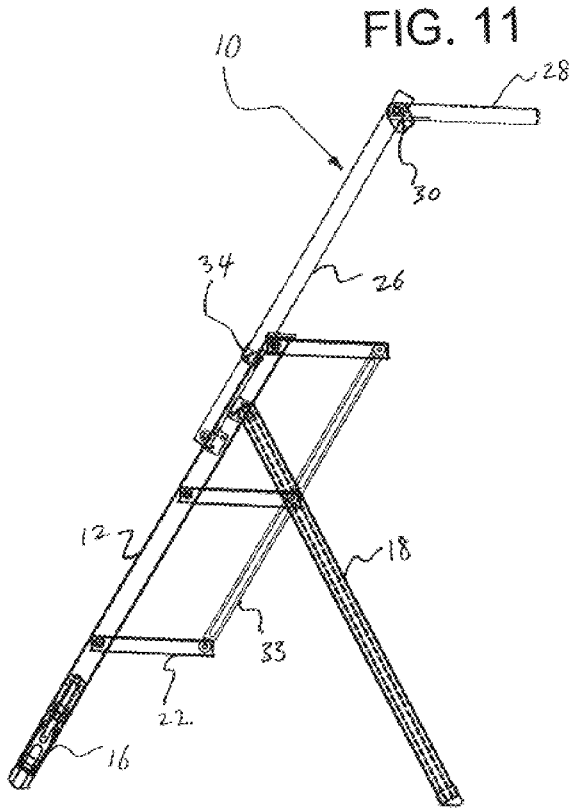
FIG. 11 is a side elevational view of the assembly in the tool tray position.
Figure 13:
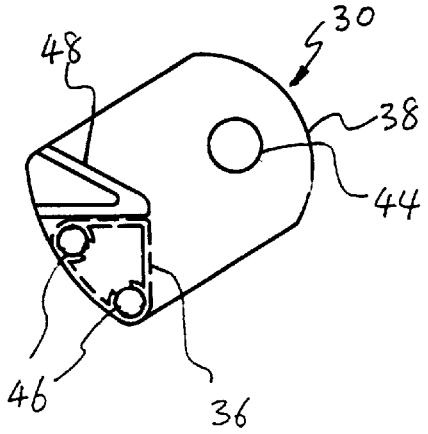
FIG. 13 is a side elevational view of the bracket.
Figure 12:
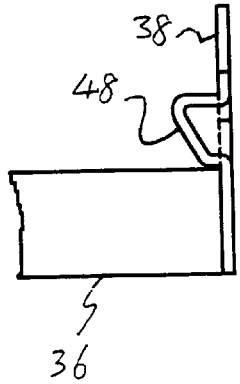
FIG. 12 is a front elevational view of a bracket.

FIGS. 10 and 11 show the assembly 10 in the tool tray position. The third frame 24 is rotated upward until it abuts the first frame 12. The third frame 24 is secured to the first frame 12 with a fastener 34 that is explained later in detail referring to FIGS. 19–23. The tray 28 is rotated counterclockwise until it is horizontal. The stop 30 abuts both the tray 28 and the third frame 24, and keeps the tray 28 horizontal. Since the tray 28 is attached at the lower end of the third frame 24, and the third frame 24 is rotated 180 degrees having the upper end of the third frame as the pivot point, the tray 28 is positioned high enough and backward enough to be useful as a tool tray when a user uses the assembly 10 as both a stepladder and a tool tray.

FIGS. 12–18 show the stop 30 in detail. The stop 30 includes a cross bar 36 and two brackets 38 fixed to the ends of the bar 36 and pivotally attached to the side rails 26 of the third frame 24. The bar 36 has a triangular cross-section. The cross-section has a first wall 40 and a second wall 42 that makes an angle of 90 degrees with the first wall 40. The bracket 38 is a shape of a small plate and has a hole 44 for the pivotal attachment to the third frame 24, two holes 46 for fixing the bar 36, and a projection 48 having a predetermined angle and abuts with the bar 36. The predetermined angle is 28 degrees, which is a half of the acute angle, 56 degrees between the first frame 12 and the second frame 18.

Figure 14:
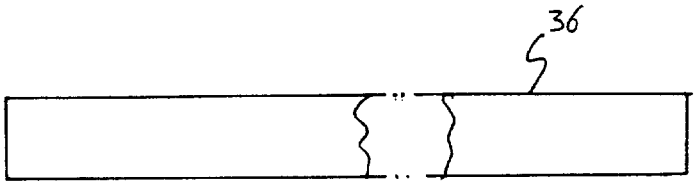
FIG. 14 is a front elevational view of a bar.
Figure 15:
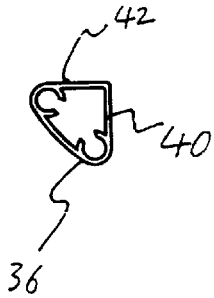
FIG. 15 is a side elevational view of the bar.
Figure 16:
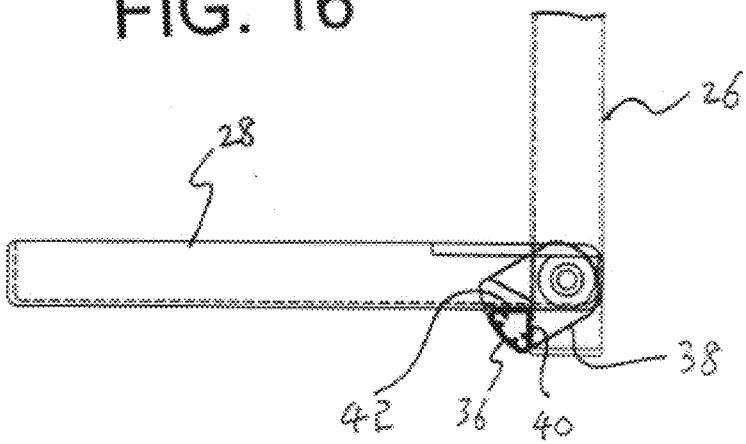
FIG. 16 is a partial side elevational view of the assembly showing a tray supported in the hand truck position.
Figure 17:
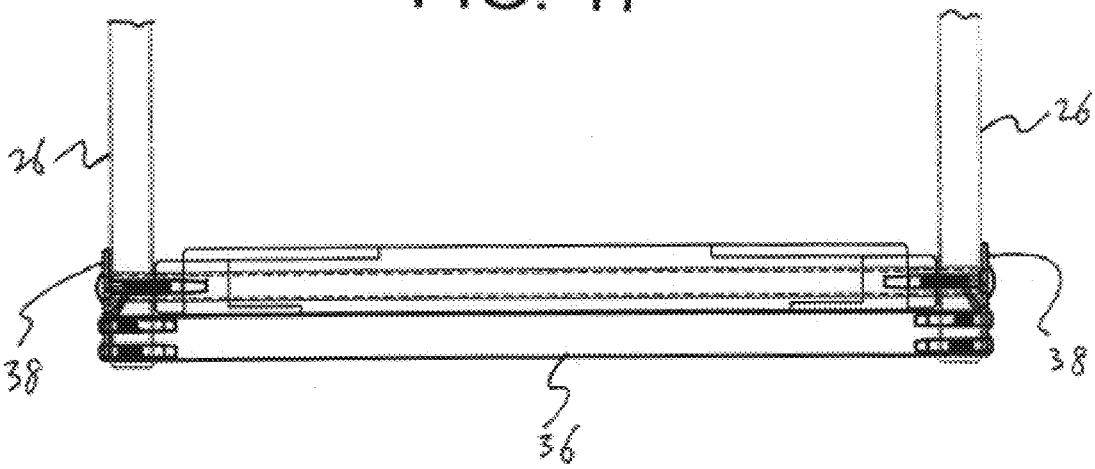
FIG. 17 is a partial front elevational view of the assembly showing the tray and the brackets and the bar supporting the tray.

In the hand truck position shown in FIGS. 14 and 15, the first wall 40 abuts on the side rails 26 of the third frame 24 so that the bracket 38 is prevented from pivoting downward further, and the second wall 42 abuts on the tray 28 so that the tray 28 is prevented from pivoting downward further. Thus, the tray 28 is kept at the position vertical to the third frame 24.

Figure 18:
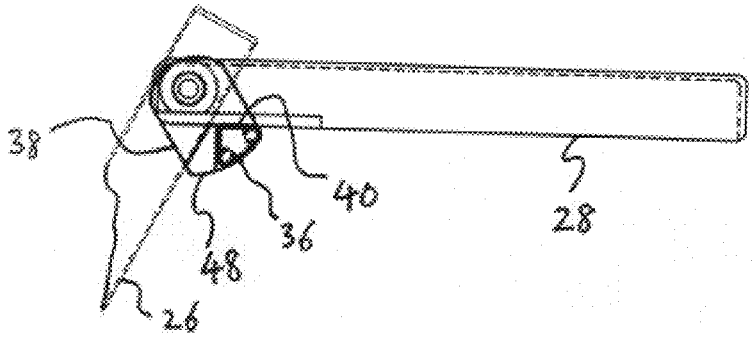
FIG. 18 is a partial side elevational view of the assembly showing the tray supported in the tool tray position.
Figure 20:
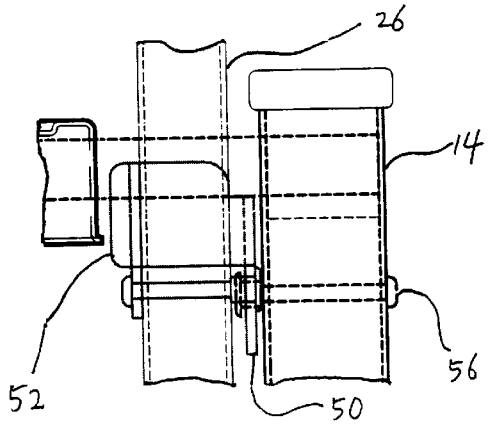
FIG. 20 is a partial front elevational view of the assembly showing the fastener in its engaged position.
Figure 19:
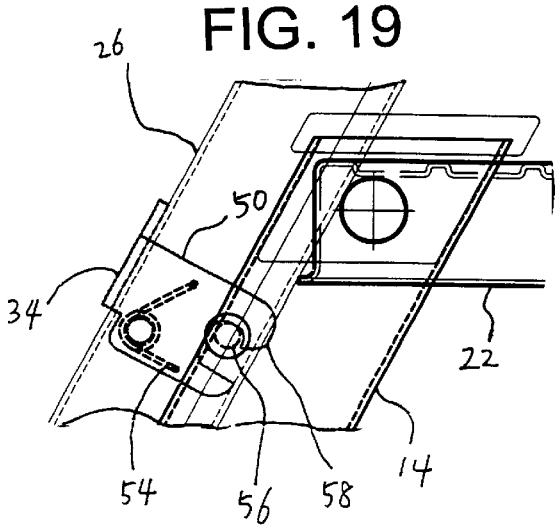
FIG. 19 is a partial side elevational view of the assembly showing a fastener in its engaged position.
Figure 21:
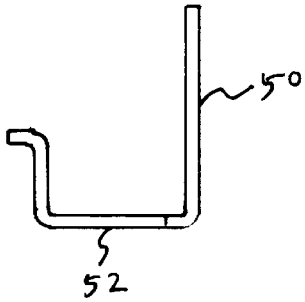
FIG. 21 is a plan view of the fastener.
Figure 22:
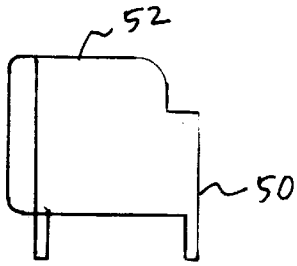
FIG. 22 is a front elevational view of the fastener.
Figure 23:
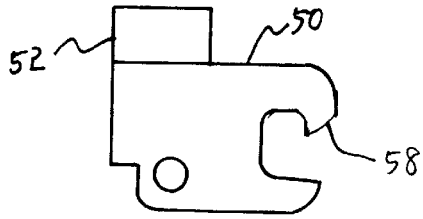
FIG. 23 is a side elevational view of the fastener.

In the tool tray position shown in FIG. 18, the first wall 40 abuts on the tray 28 so that the tray 28 is prevented from rotating further downward, and the projections 48 abut on the side rails 26 of the third frame 24 so that the brackets 38 are prevented from pivoting downward further. Thus, the tray 28 is kept horizontal.

FIGS. 19–23 show the fastener 34 in detail. The fastener 34 includes a hook 50 pivotally attached to the side rail 26 of the third frame 24, a handle 52 extending vertically from the hook 50 and leaning on the side rail 26, and a spring 54 provided at the pivoting point of the hook 50. The spring 54 presses the fastener 34 onto the rail 26. When the third frame 24 is rotated upward and about to abut on the first frame 12, an end 58 of the hook 50 contacts a pin 56 provided at the side rail 14 of the first frame 12. As the end 58 slides over the pin 56, the hook 50 is rotated counterclockwise against the force of the spring 54 and then rotated clockwise by the spring force for the hook 50 to engage the pin 56. The spring 54 keeps this engagement to keep the third frame 24 abutted on the first frame 12 when the assembly 10 is used in the tool tray position. To rotate the third frame 24 to its folded position, a user lifts the handle 52 against the spring force so that the fastener 34 is rotated counterclockwise and the hook 50 is disengaged from the pin 56.

FIGS. 24–33 show the castor 16 in detail. The castor 16 has a wheel bracket 60 rotatably attached at the lower end of the side rail 14 of the first frame 12, and a wheel 62 having a shape of a disc and rotatable attached to the wheel bracket 60.

Figure 24:
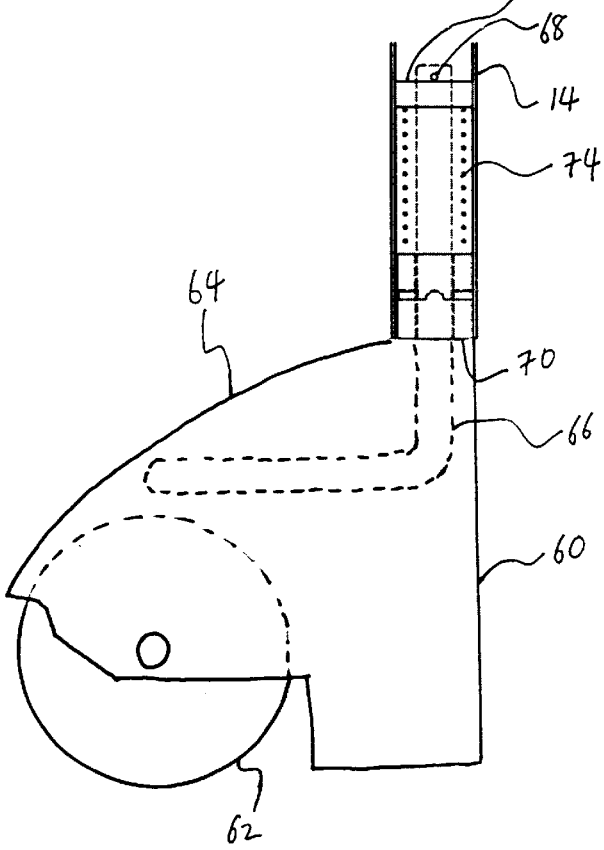
FIG. 24 is a front elevational view of a castor.
Figure 25:
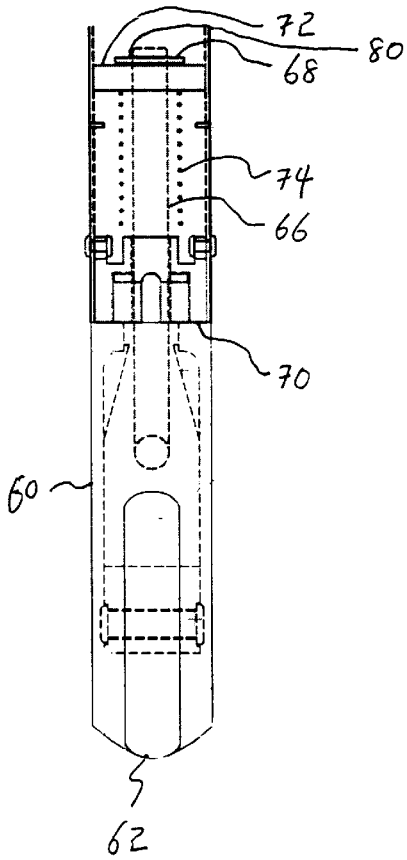
FIG. 25 is a side elevational view of the castor.
Figure 26:
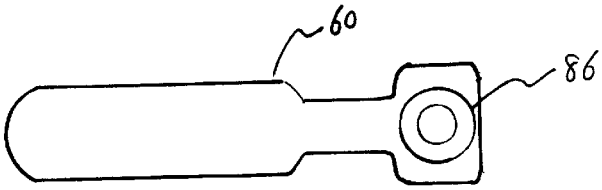
FIG. 26 is a plan view of a wheel cover.
Figure 27:
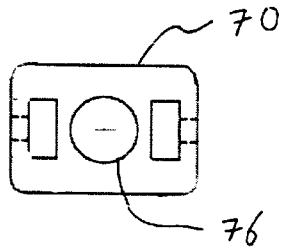
FIG. 27 is a plan view of a first block for the positioning of the castor.
Figure 29:
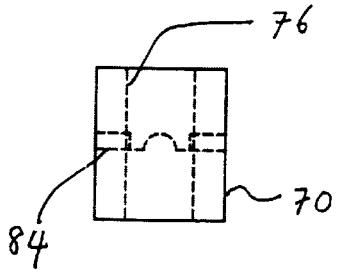
FIG. 29 is a side elevational view of the first block.
Figure 28:
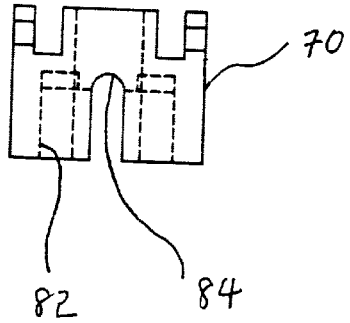
FIG. 28 is a front elevational view of the first block.
Figure 30:
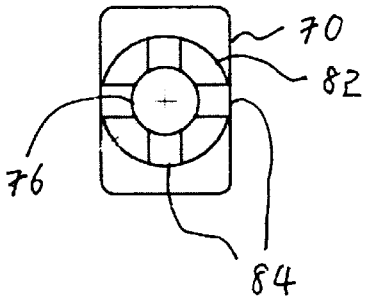
FIG. 30 is a bottom view of the first block.
Figure 31:
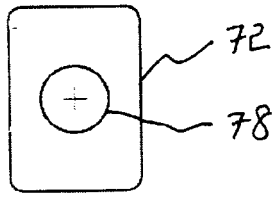
FIG. 31 is a plan view of a second block.
Figure 32:
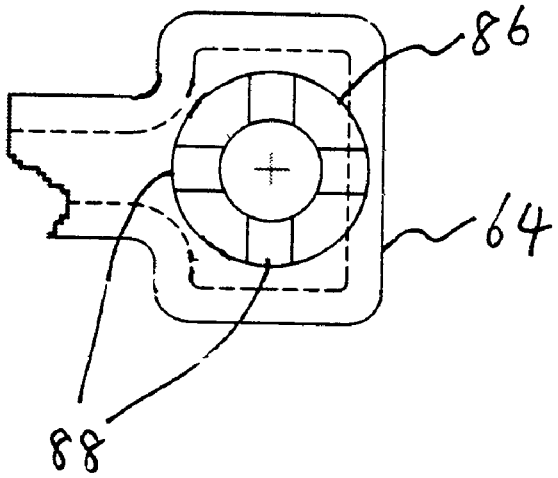
FIG. 32 is a plan view of a boss protruded from a wheel cover.
Figure 33:
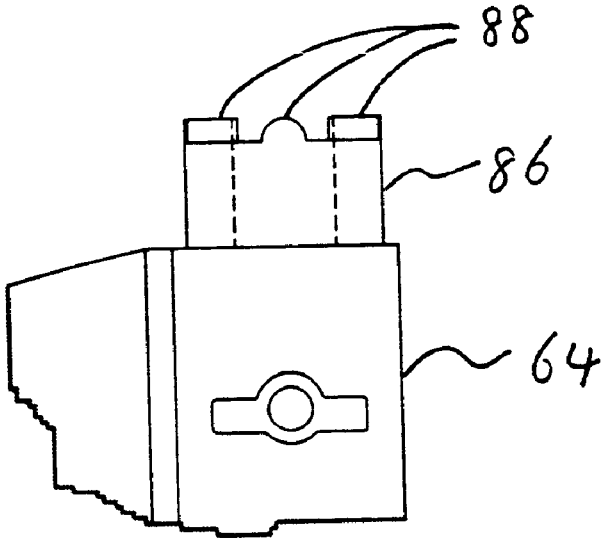
FIG. 33 is an elevational view of the boss.
Figure 34:
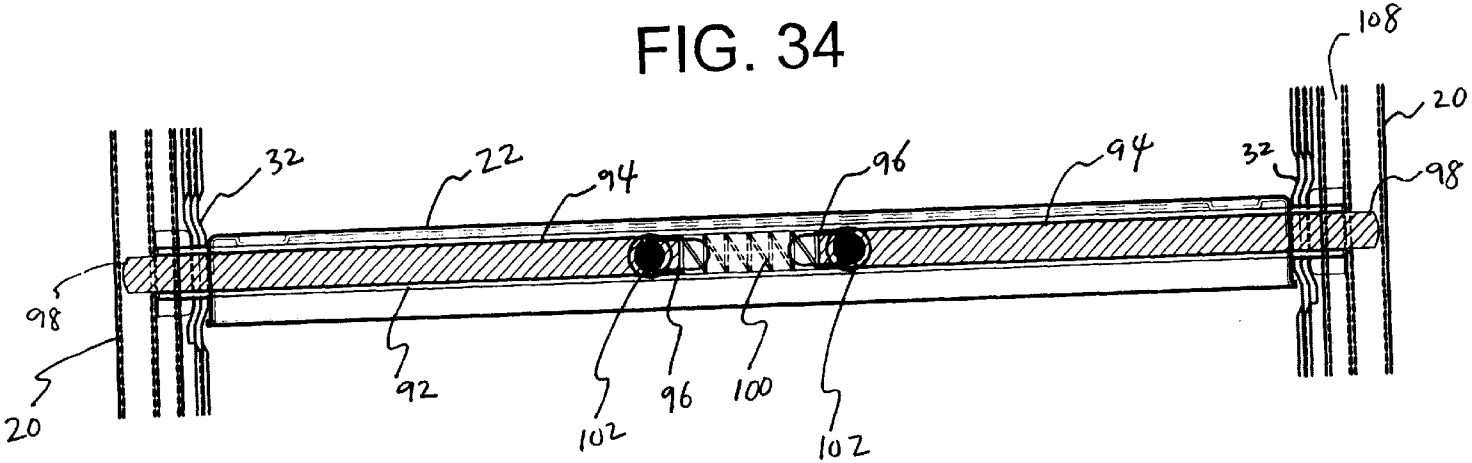
FIG. 34 a cross-sectional view of a lock in its locked state, viewed from the back of the assembly in the stepladder position.
Figure 35:
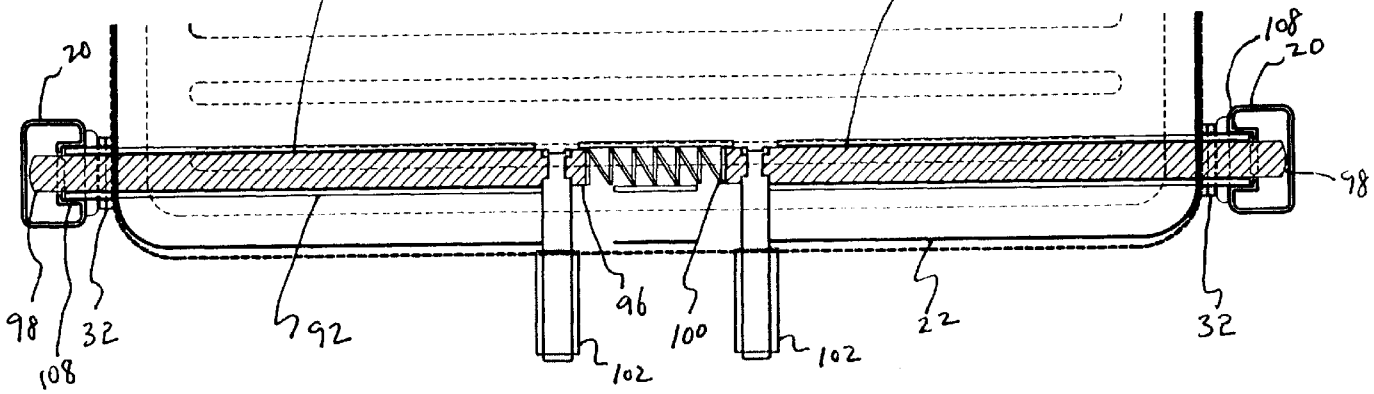
FIG. 35 is a cross-sectional view of the lock in its locked state, viewed from the above of the assembly in the stepladder position.
Figure 36:
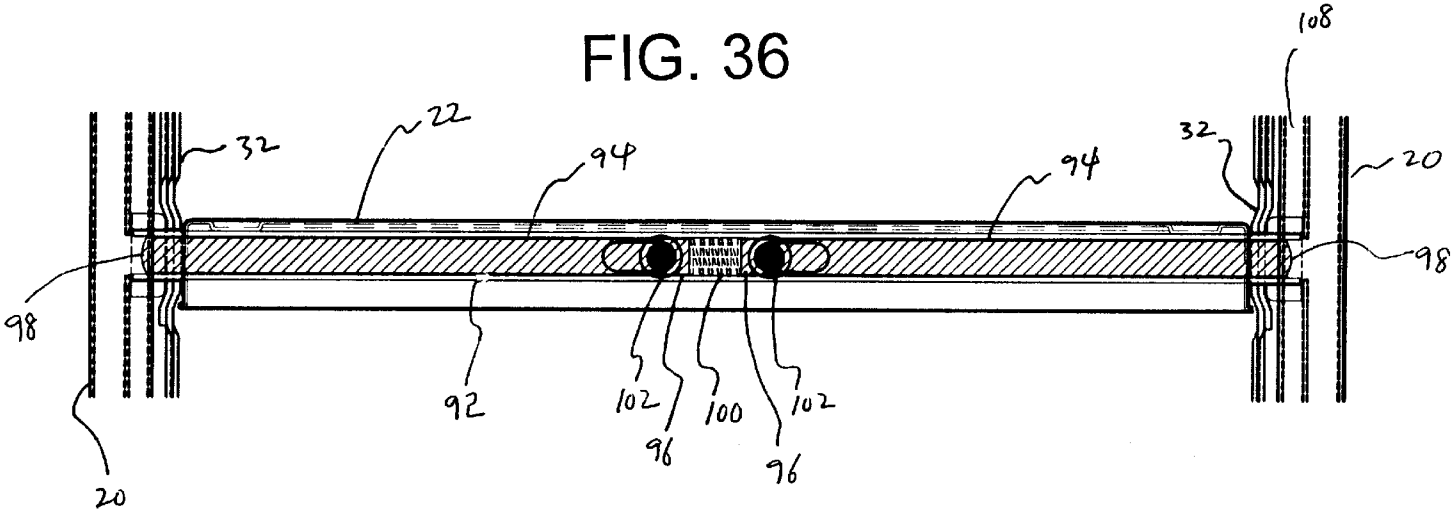
FIG. 36 is a cross-sectional view of the lock in its unlocked state, viewed from the back of the assembly in the stepladder position.
Figure 37:
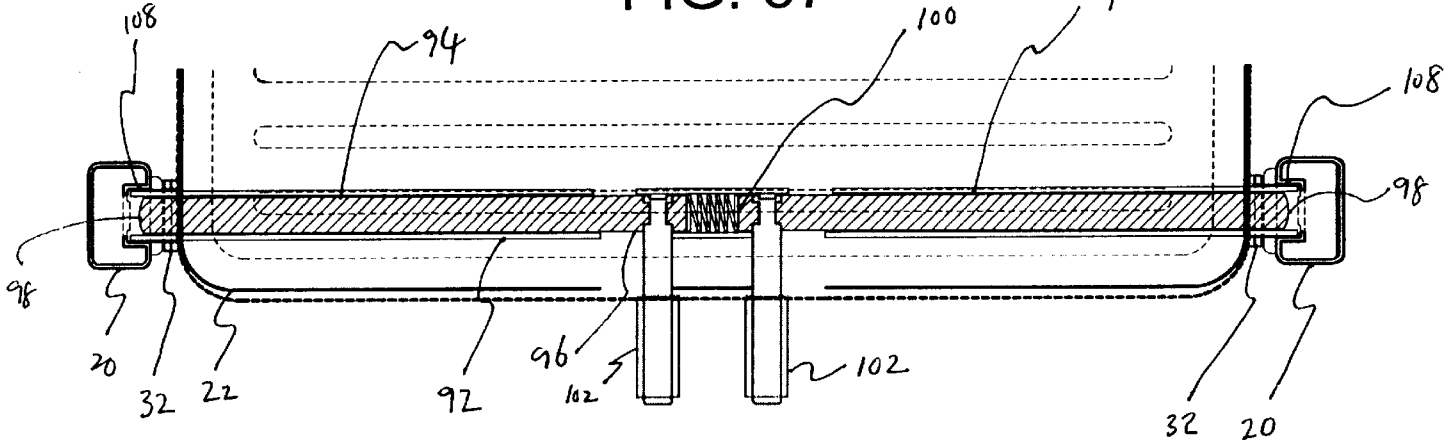
FIG. 37 is a cross-sectional view of a lock in its unlocked state, viewed from the above of the assembly in the stepladder position.
Figure 38:
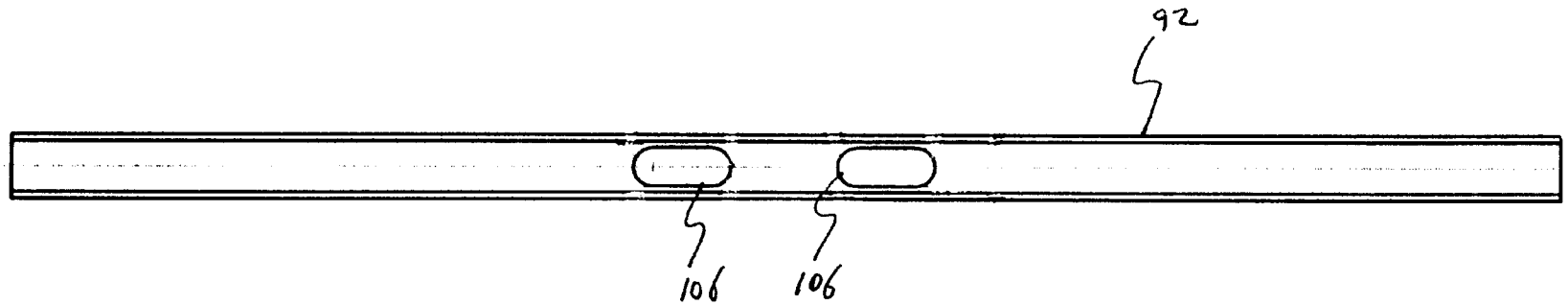
FIG. 38 is an elevational view of a tube for the lock.

The side rail 14 is hollow and has a rectangular cross-section. The wheel bracket 60 has a wheel cover 64, a shaft 66 fixed to the wheel cover 64, a pin 68, a first block 70, a second block 72, and a spring 74. The wheel 62 is rotatably attached to the wheel cover 64. The first block 70 is secured at the lower end of the side rail 14 as shown in FIGS. 24 and 25 and has a hole 76 receiving the shaft 66. The second block 72 is slidably received inside the side rail 14 and has a hole 78 receiving the shaft 66. The pin 68 is inserted into a bore 80 provided at an end of the shaft 66 and contacts with the second block 72 to limit the sliding movement of the second block 72 within the side rail 14. The spring 74 surrounds the shaft 66 between the first block 70 and the second block 72 so that the displacement of the spring is limited between the blocks. The first block 70 has a circular recess 82 having four grooves 84 spaced by 90 degrees with one another at its bottom. The wheel cover 64 has a circular boss 86 that is received in the recess 82 of the first block 70 and has four projections 88 spaced by 90 degrees with one another at its top. The projections 88 engage with the grooves 84 and hence the recess 82 and the boss 86 are engaged.

Pulling the wheel bracket 60 downward disengages the recess 82 and the boss 86, and allows the castor 16 to rotate freely. Also, the shaft 66 is moved downward together with the pin 68 and the second block 72 compressing the spring 74.

When a force pulling the wheel bracket 60 downward is removed, the wheel bracket 60 is returned to the original position by the force of the spring 74, and the projections 88 and the grooves 84' engage again.

The evenly spaced four projections 88 and the corresponding grooves 84 define four lockable positions for the castor 16. In the first position, the castors 16 are positioned between the side rails 14 of the first frame 12. In the second position, the castors 16 are rotated 90 degrees from the first position and backward from the first frame 12. In the third position, the casters 16 are rotated 180 degrees from the first position. In the fourth position, the castors 16 are rotated 270 degrees from the first position.

The castors 16 are locked in the first position when the assembly 10 is in the folded position. The castors 16 are locked in the second position when the assembly 10 is in the hand truck position. The castors 16 are locked in the third position when the assembly is in the stepladder position or in the tool tray position. FIGS. 34–38 show the lock 90 for securing the second frame 18 at the acute angle with the first frame 12 in detail. The lock 90 includes a tube 92 positioned inside the step 22, two rods 94 received in the tube 92, each of which having an inner end 96 and an outer end 98, and a spring 100 received in the tube 92 between the inner ends 96 of the rods 94. The spring 100 pushes the rods 94 away from each other.

The step 22 is one near the upper end of the second frame 18, and is the middle one in FIG. 4. When the second frame 18 is pivoted to make the acute angle with the first frame 12, the lock 90 locks the link 33 formed by the first frame 12, the steps 22, and the bars 32 to the second frame 18. Thus, the second frame 18 is locked with the first frame 12 via the link 33. In this way, when the second frame 18 is fully unfolded, the link 33 is also fully unfolded and the steps 22 become horizontal so that the assembly 10 is used as a stepladder or a tool tray.

Each of the rod 94 has a handle 102 fixed vertical to the rod 94 at the inner end 96. The handles 102 extend out of the step 22 by passing through slots 106 provided on the tube 92 and slots 104 provided on the step 22. The handles 102 moves toward each other within the slots 104, 106 to move the rods 94 toward each other against the force of the spring 100.

When the link 33 is unfolded, the outer end 98 of each of the rods 94 is received in and slides in a channel 108 provided in the side rails 20 of the second frame 18. When the link 33 is fully unfolded, the outer end 98 is inserted into a hole 110 provided in the channel 108, and thus provides a sturdy lock for the link 33.

In order to fold the link and to convert the assembly 10 into the hand truck position, or the folded position, a user moves the handles 102 toward each other so that the outer ends 98 of the rods 94 move out of the holes 110. The user then pivots the second frame 18 a little toward the first frame 12, and then may release the handles 102. The rods 94 slide in the channels 108 during the folding.

With the above construction, the present invention has an advantage that the stepladder and hand truck assembly has a very compact size. Since the steps collapse downward into the frames, and the tray and the castors are unfolded into the frames, the assembly has the minimum possible size in the folded position. Another advantage is that only easy and simple operations are required to convert the assembly between the folded, hand truck, stepladder, and tool tray positions. Only pivoting the frames or rotating the tray is required to change positions of the assembly. Engaging of the locks is automatic and only disengaging locks is done manually. Still another advantage is that the assembly is sturdy and stable when it is used in any positions. All the elements are kept in position by locks or gravity in any service positions of the assembly.

Although the invention has been described in considerable detail, other versions are possible by converting the aforementioned construction. Therefore, the scope of the invention shall not be limited by the specification specified above and the appended claims.

What is claimed is:

1. A combined stepladder and hand truck assembly comprising:

a) a first frame having two side rails, each of the side rails having a lower end;

b) a second frame pivotally attached to the back side of the first frame, the second frame having two side rails, each of the side rails of the second frame having an upper end and pivotally attached to the side rail of the first frame at the upper end;

c) a third frame pivotally attached to the front side of the first frame, the third frame having two side rails, each of the side rails of the third frame having an upper end and a lower end and pivotally attached to the side rail of the first frame at the upper end;

d) two bars;

e) a plurality of steps, the steps pivotally attached to the side rails of the first frame and the bars so that the steps, the side rails of the first frame, and the bars form a parallelogram linkage;

f) a lock securing the second frame with the first frame at an acute angle between the second frame and the first frame;

g) two casters attached at the lower end of the side rail of the first frame;

h) a fastener securing the third frame to the first frame;

i) a tray rotatably attached to the third frame at the lower ends of the side rails of the third frame; and j) a stop limiting the rotation of the tray;

wherein the assembly has a folded position, a hand truck position, a stepladder position, and a tool tray position;

wherein in the folded position, the second frame and the third frame abut on the first frame parallel thereto, the lock is released, the fastener is released, the linkage is folded between the side rails of the first frame and the second frame, and the tray is folded between the side rails of the third frame;

wherein in the hand truck position, the second frame and the third frame abut on the first framed parallel thereto, the lock is released, the fastener is released, the linkage is folded between the side rails of the first frame and the second frame, the tray is rotated downward until the tray abuts on the stop so that the tray is substantially perpendicular to the third frame;

wherein in the stepladder position, the second frame is pivoted so that it makes the acute angle with the first frame, the lock is engaged, the third frame abuts on the first frame and is parallel thereto, the fastener is released, the (linkage is unfolded so that the steps are substantially horizontal, and the tray is folded between the side rails of the third frame; and wherein in the tool tray position, the second frame is pivoted so that it makes the acute angle with the first frame, the lock is engaged, the third frame is rotated upward, the fastener is engaged, the linkage is unfolded so that the steps are substantially horizontal, and the tray is rotated until the tray abuts on the stop so that the tray is substantially horizontal.

2. The combined stepladder and hand truck assembly of claim 1 wherein the steps are pivoted downward when the linkage is folded.

3. The combined stepladder and hand truck assembly of claim 1 wherein the stop comprises two brackets rotatably attached to the side rails of the third frame near the lower ends of the side rails, and a stop bar fixed between the brackets;

wherein the stop bar has a first wall and a second wall, and each of the bracket has a projection, and the first wall and the second wall makes an angle of approximately 90 degrees;

wherein when the assembly is in the hand truck position, the first wall abuts on the side rails of the third frame to block downward pivoting of the brackets, and the second wall abuts on the tray to block downward rotation of the tray; and wherein when the assembly is in the tool tray position, the projections abuts on the side rails of the third frame to block downward pivoting of the brackets, and the first wall abuts on the tray to block downward rotation of the tray.

4. The combined stepladder and hand truck assembly of claim 1 wherein the fastener includes a hook pivotally attached to the side rail of the third frame, a handle, and a spring, wherein the hook engages a pin provided at the side rail of the first frame and the spring presses the hook so that the hook is kept engaged with the pin, and wherein the handle is used to pivot the fastener against the force of the spring to disengage the hook from the pin.

5. The combined stepladder and hand truck assembly of claim 1 wherein each of the casters has a wheel bracket attached at the lower end of the side rail of the first frame, and a wheel rotatably attached to the wheel bracket;

wherein the wheel bracket is rotatable around the side rail and lockable on a first position, a second position, or a third position; and wherein in the first position, the castors are positioned between the side rails of the first frame, and in the second position, the castors are rotated 90 degrees from the first position and backward from the first frame, and in the third position, the casters are rotated 180 degrees from the first position.

6. The combined stepladder and hand truck assembly of claim 5 wherein the castors are locked in the first position when the assembly is in the folded position.

7. The combined stepladder and hand truck assembly of claim 5 wherein the castors are locked in the second position when the assembly is in the hand truck position.

8. The combined stepladder and hand truck assembly of claim 5 wherein the castors are locked in the third position when the assembly is in the stepladder position or in the tool tray position.

9. The combined stepladder and hand truck assembly of claim 5 wherein the side rails of the first frame are hollow, wherein the wheel bracket of the caster includes a wheel cover, a shaft, a pin, a first block, a second block, and a spring, wherein the wheel is rotatably attached to the wheel cover and the shaft is fixed to the wheel cover, wherein the first block is secured at the lower end of the side rail of the first frame and has a hole receiving the shaft, wherein the second block is slidably received inside the side rail of the first frame and has a hole receiving the shaft, wherein the pin is inserted into a bore provided at an end of the shaft and contacts with the second block to limit the sliding movement of the second block, wherein the spring surrounds the shaft between the first block and the second block, wherein the first block has a circular recess having four grooves spaced by 90 degrees with one another, and the wheel cover has a circular boss received in the recess of the first block and having four projections spaced by 90 degrees with one another to engage with the recesses of the first block.

10. A combined stepladder and hand truck assembly comprising:

a) a first frame having two side rails, each of the side rails having a lower end;

b) a second frame pivotally attached to the back side of the first frame, the second frame having two side rails, each of the side rails of the second frame having an upper end and pivotally attached to the side rail of the first frame at the upper end;

c) a third frame pivotally attached to the front side of the first frame, the third frame having two side rails, each of the side rails of the third frame having an upper end and a lower end and pivotally attached to the side rail of the first frame at the upper end;

d) two bars;

e) a plurality of steps, the steps pivotally attached to the side rails of the first frame and the bars so that the steps, the side rails of the first frame, and the bars form a parallelogram linkage;

f) a lock securing the second frame with the linkage at an acute angle between the second frame and the first frame;

g) two casters attached at the lower end of the side rail of the first frame;

h) a fastener securing the third frame to the first frame;

i) a tray rotatably attached to the third frame at the lower ends of the side rails of the third frame; and j) a stop limiting the rotation of the tray;

wherein the assembly has a folded position, a hand truck position, a stepladder position, and a tool tray position;

wherein in the folded position, the second frame and the third frame abut on the first frame and parallel thereto, the lock is released, the fastener is released, the link is folded between the side rails of the first frame and the second frame, and the tray is folded between the side rails of the third frame;

wherein in the hand truck position, the second frame and the third frame abut on the first frame and parallel thereto, the lock is released, the fastener is released, the linkage is folded between the side rails of the first frame and the second frame, the tray is rotated downward until the tray abuts on the stop so that the tray is substantially perpendicular to the third frame;

wherein in the stepladder position, the second frame is pivoted so that it makes the acute angle with the first frame, the lock is engaged, the third frame abuts on the first frame and is parallel thereto, the fastener is released, the linkage is unfolded so that the steps are substantially horizontal, and the tray is folded between the side rails of the third frame; and wherein in the tool tray position, the second frame is pivoted so that it makes the acute angle with the first frame, the lock is engaged, the third frame is rotated upward, the fastener is engaged, the linkage is unfolded so that the steps are substantially horizontal, and the tray is rotated until the tray abuts on the stop so that the tray is substantially horizontal.

11. The combined stepladder and hand truck assembly of claim 10 wherein the steps are pivoted downward when the linkage is folded.

12. The combined stepladder and hand truck assembly of claim 10 wherein the lock comprises a tube positioned inside one of the steps, two rods received In the tube, each of the rods having an inner end and an outer end, and a spring received in the tube between the inner ends of the rods and pushing the rods away from each other;

wherein each of the rod comprises a handle fixed at the inner end of the rod, wherein the handles pass through slots provided on the tube and on the step so that the handles can move within the slots to move the rods toward each other against the force of the spring;

wherein each of the side rails of the second frame has a channel to receive the outer end of the rod, and the channel has a hole to receive the outer end of the rod at a position in which the first frame and the second frame makes the acute angle; and whereby the outer ends of the rods slide in the channels of the second frame during unfolding of the link, and are inserted into the holes of the second frame when the linkage is unfolded fully.

13. The combined stepladder and hand truck assembly of claim 10 wherein the stop comprises two brackets rotatably attached to the side rails of the third frame near the lower ends of the side rails, and a stop bar fixed between the brackets;

wherein the stop bar has a first wall and a second wall, and each of the bracket has a projection, and the first wall and the second wall makes an angle of approximately 90 degrees;

wherein when the assembly is in the hand truck position, the first wall abuts on the side rails of the third frame to block downward pivoting of the brackets, and the second wall abuts on the tray to block downward rotation of the tray; and wherein when the assembly is in the tool tray position, the projections abuts on the side rails of the third frame to block downward pivoting of the brackets, and the first wall abuts on the tray to block downward rotation of the tray.

14. The combined stepladder and hand truck assembly of claim 10 wherein the fastener includes a hook pivotally attached to the side rail of the third frame, a handle, and a spring, wherein the hook engages a pin provided at the side rail of the first frame and th spring presses the hook so that the hook is kept engaged with the pin, and wherein the handle is used to pivot the fastener against the force of the spring to disengage the hook from the pin.

15. The combined stepladder and hand truck assembly of claim 10 wherein each of the casters has a wheel bracket attached at the lower end of the side rail of the first frame, and a wheel rotatably attached to the wheel bracket;

wherein the wheel bracket is rotatable around the side rail and lockable on a first position, a second position, or a third position; and wherein in the first position, the castors are positioned between the side rails of the first frame, and in the second position, the castors are rotated 90 degrees from the first position and backward from the first frame, and in the third position, the casters are rotated 180 degrees from the first position.

16. The combined stepladder and hand truck assembly of claim 15 wherein the castors are locked in the first position when the assembly is in the folded position.

17. The combined stepladder and hand truck assembly of claim 15 wherein the castors are locked in the second position when the assembly is in the hand truck position.

18. The combined stepladder and hand truck assembly of claim 15 wherein the castors are locked in the third position when the assembly is in the stepladder position or in the tool tray position.

19. The combined stepladder and hand truck assembly of claim 15 wherein the side rails of the first frame are hollow, wherein the wheel bracket of the caster includes a wheel cover, a shaft, a pin, a first block, a second block, and a spring, wherein the wheel is rotatably attached to the wheel cover and the shaft is fixed to the wheel cover, wherein the first block is secured at the lower end of the side rail of the first frame and has a hole receiving the shaft, wherein the second block is slidably received inside the side rail of the first frame and has a hole receiving the shaft, wherein the pin is inserted into a bore provided at an end of the shaft and contacts with the second block to limit the sliding movement of the second block, wherein the spring surrounds the shaft between the first block and the second block, wherein the first block has a circular recess having four grooves spaced by 90 degrees with one another and the wheel cover has a circular boss received in the recess of the first block and having four projections spaced by 90 degrees with one another to engage with the recesses of the first block.

* * * * *